US005121313A

United States Patent [19]

Chang

[11] Patent Number: 5,121,313

[45] Date of Patent: Jun. 9, 1992

[54] LAMP HOLDER HAVING A VASE-SHAPED CRACKED BODY

[76] Inventor: Ko A. Chang, No. 8, Alley 12 Lane 483, Tsing Yun Rd., Tu Cheng Hsiang, Taipei Hsien, Taiwan

[21] Appl. No.: 734,431

[22] Filed: Jul. 23, 1991

[51] Int. Cl.[5] ..... F21S 1/12

[52] U.S. Cl. ..... 362/412; 362/390

[58] Field of Search ..... 362/412, 414, 806, 390, 362/363, 374

[56] References Cited

U.S. PATENT DOCUMENTS 1,881,594 10/1932 Hotchkin ..... 362/414
3,222,512 12/1965 Dickson ..... 362/390

FOREIGN PATENT DOCUMENTS 803918 4/1951 Fed. Rep. of Germany ..... 362/412
1025251 1/1953 France ..... 362/412
73037 1/1917 Switzerland ..... 362/412
242454 10/1946 Switzerland ..... 362/412
261303 6/1926 United Kingdom ..... 362/412

*Primary Examiner*—Ira S. Lazarus
*Assistant Examiner*—L. Heyman
*Attorney, Agent, or Firm*—Bacon & Thomas

[57] ABSTRACT

A lamp holder having a cracked vase-shaped body with irregular fragments formed thereon to produce a special visual affect. It uses a protecting cover positioned on the top of the vase to even out the fastening compression forces, and a resilient ring member is placed between and in registration with the rim portion of the vase and a recess formed in the facing side of the protecting cover to absorb and evenly distribute compression or impact forces to the vase, and prevent further crack propagation.

3 Claims, 3 Drawing Sheets

LAMP HOLDER HAVING A VASE-SHAPED CRACKED BODY

BACKGROUND OF THE INVENTION

The present invention is generally related to a lamp holder, particularly to the type having a vase-shaped body with irregular cracks formed thereon to produce desired visual effects.

It has been known to form a lamp holder which uses a porcelain material vase body. The vase body may have cracks on its exterior to create an attractive appearance. However, applicant has independently developed a lamp holder utilizing cracked glass material defined by a plurality of irregular fragments, on which reflected light creates interference, and which produces special visual effects.

The utilization of a cracked glass vase body, however, is subject to a problem, since a crack between adjacent glass fragments tend to propagate and cause further cracking.

SUMMARY OF THE INVENTION

A lamp holder according to the present invention is characterized by utilizing a protecting cover pressing on a cracked upper opening of the glass vase body to provide even fastening compression forces. The protecting cover has a recess in registration with the upper opening of the vase body. Between the protecting cover and the vase body, a resilient ring member is positioned to absorb and evenly distribute the compressing forces or impacts.

Therefore, it is an objective of the present invention to provide a lamp holder with a vase-shaped body having cracks thereon to provide visual attraction.

It is another objective of the present invention to utilize a protecting cover with the help of a resilient ring member to prevent further crack propagation.

DETAILED DESCRIPTION OF THE PREFERRED EMBODIMENT

Figure 1:
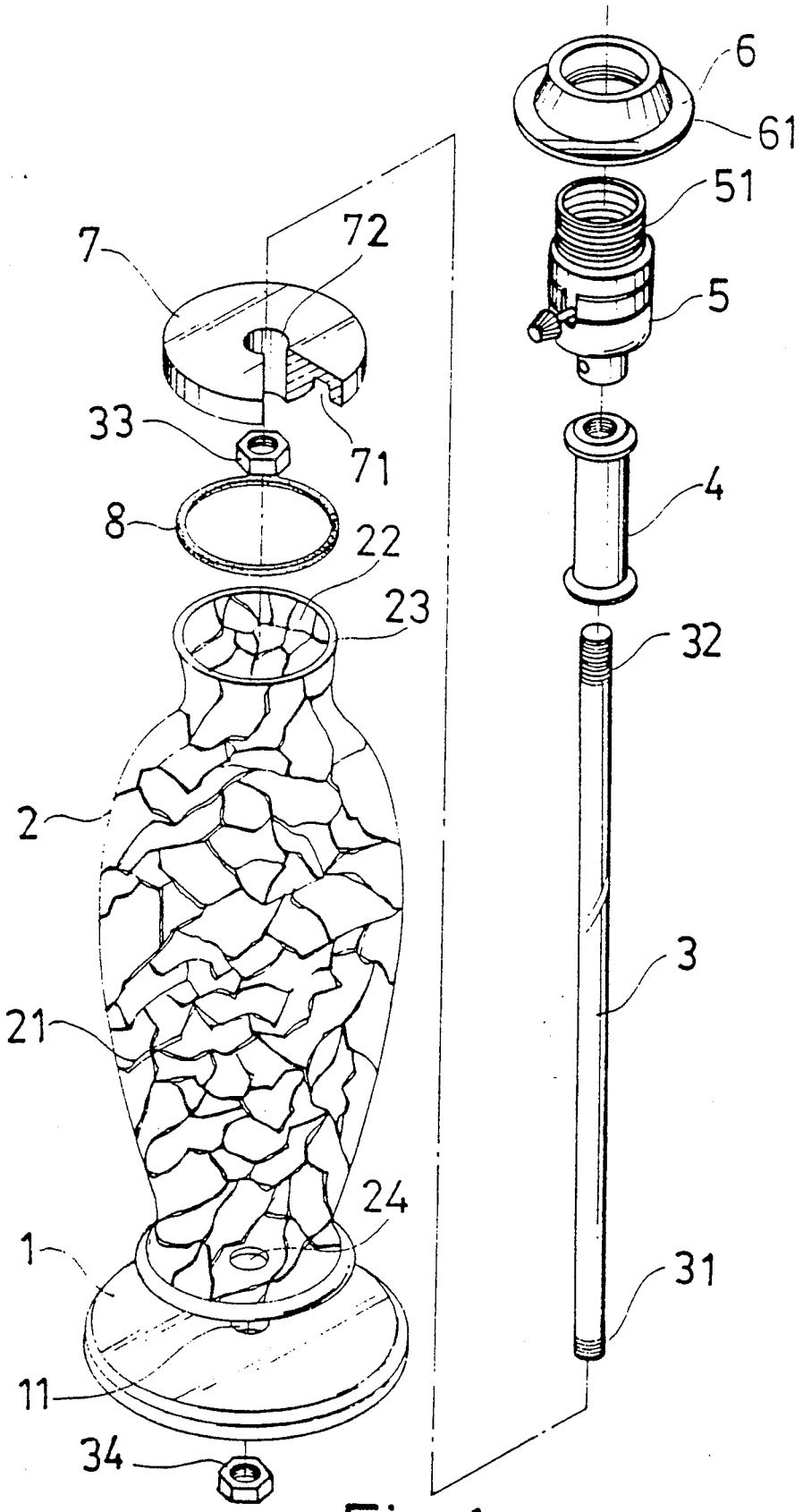
FIG. 1 is a perspective exploded view showing the assembly of a lamp holder according to the present invention.

As shown in FIG. 1, a lamp holder according to the present invention is formed of a cracked vase-shaped body 2 defining irregular fragments 21 thereon, having a rim portion 23 on the top of body 2 to define a first opening 22 and a second opening 24 defined on the bottom. A bottom plate 1 is provided having a generally disk-shaped configuration with an aperture 11 formed at substantially its center and placed under the vase-shaped body 2.

A resilient ring member 8 having a diameter identical to that of the rim portion 23 is placed on the vase-shaped body 2, and on which member 8 a protecting cover 7 is placed so that an annular recess 71 therein is in registration with the rim portion 23.

Figure 3:
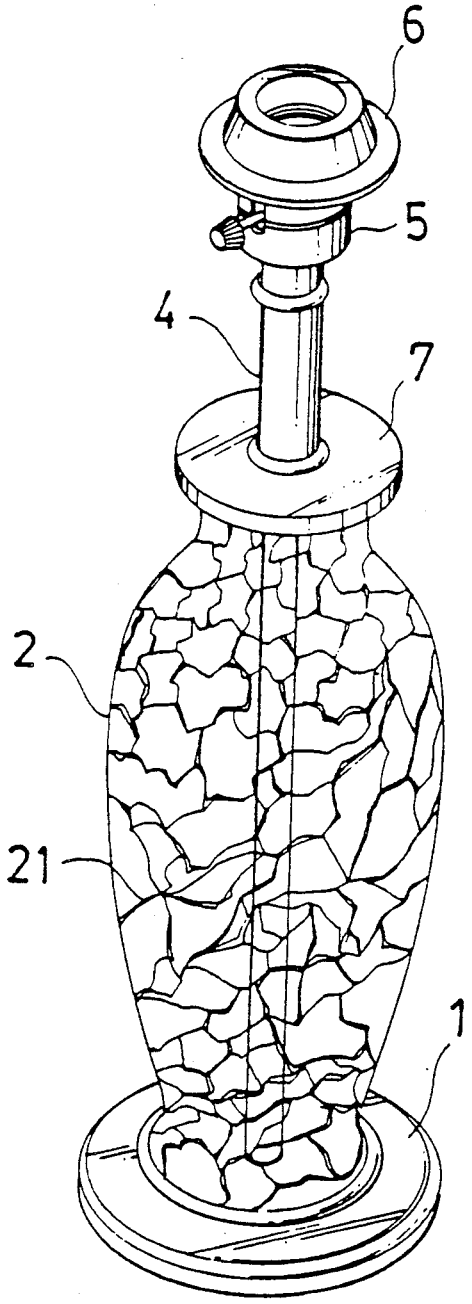
FIG. 3 is a perspective view showing the lamp holder in assembled position.

Inserted through the second opening 24 of the vase-shaped body and further through the aperture 11 of the bottom plate 1 and a through hole 72 of the protecting cover 7 is a fixing bar 3, having a top threaded portion 32 connected to a first screw nut 33, and similarly a bottom threaded portion 31 connected to a second screw nut 34. Therefore, the vase 2 can be secured firmly together from both ends thereof, as shown in FIG. 3.

Figure 2:
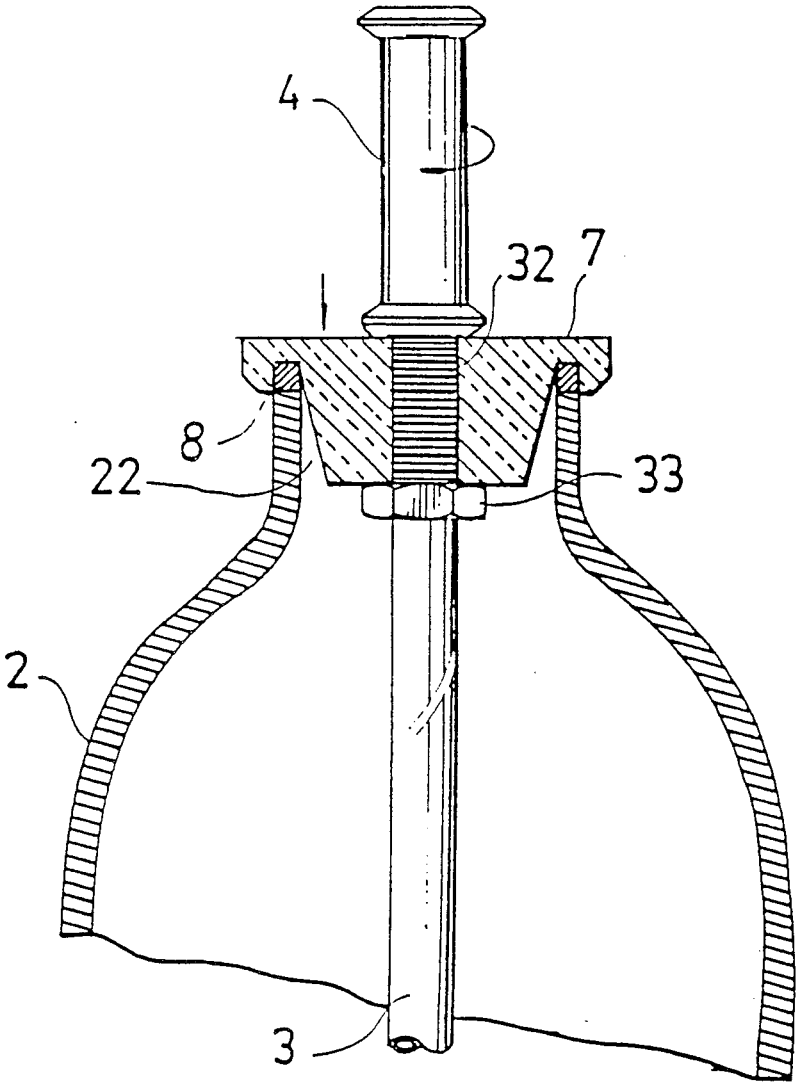
FIG. 2 is a partial cross-sectional view showing the resilient protecting cover.

Turning now to FIG. 2, the annular protecting cover 7 with the recess 71 is made of resilient material, which absorbs impact and evenly distributes compression forces, so that the possibility of further cracking at the joints between the irregular fragments 21 can be greatly reduced. In fact, the present invention has unexpectedly resolved the problem which is often found in the conventional type of cracked vase lamp holder.

The top threaded portion 32 is of sufficient length to extend out of the through hole 72 to receive an inner threaded tubular member 4.

Mounted on the top of the tubular member 4 is a lamp socket 5 with an exterior threaded portion 51 for receiving a protecting cap 6 with a peripheral skirt 61 to avoid directly contacting a lamp (not shown) from underneath.

It is further noted that the irregular fragments 21 so formed on the glass vase body 2 can interfere with a light source and generate special visual effects.

The cracked vase body 2 can be formed in any known manner. For example, vase body 2 can first be formed by a conventional glass-blowing method for forming a vase body. During such forming, the vase body is at a temperature of about 900°-1200° C. The cracking of the vase body is accomplished by quenching the body at the latter temperature in water maintained at a temperature of about 100° C. The immediate cooling afforded by the water quench results in the formation of irregular cracks over the vase body to provide a fragmented appearance. The cracking results because the hot vase body is subjected to different thermal stresses on the inner and outer surfaces thereof, thus resulting in fragmentation of the outer surface.

What is claimed is:

1. A lamp hold for use in combination with a light source comprising:

a) a cracked glass vase-shaped body having an outer surface defined by a plurality of irregular fragments, the body including a top rim portion forming a first opening and a bottom provided with a second opening therethrough;

b) a resilient rim member on said rim portion;

c) a protecting cover having an axial hole formed therethrough and an annular recess surrounding said axial hole, the protecting cover being disposed in engagement with the top of the body whereby the resilient rim member and rim portion are received within the annular recess;

d) a bottom plate having a substantially disk-shaped configuration and provided with a central aperture therethrough, the bottom plate being disposed in engagement with the bottom of the vase body and the central aperture being aligned with the second opening;

e) a fixing bar having an upper threaded portion and a bottom threaded portion, the fixing bar being inserted through the body, with the upper threaded portion extending outwardly through the axial hole of the protecting cover and the bottom threaded portion extending outwardly through the second opening and central aperture. upper threaded means engaging the upper threaded portion and lower threaded means engaging the lower threaded portion for applying compressive forces to the top and bottom of the vase body to thereby secure the lamp holder together and prevent further propagation of the cracks;

f) an internally threaded tubular member secured to the upper threaded portion;

g) a lamp socket assembly mounted on the tubular member for electrical engagement with a light source, the lamp socket including a top threaded portion; and h) a protecting cap threadedly mounted to the top threaded portion of the lamp socket for preventing direct contact with a light bulb from therebelow.

2. The lamp holder of claim 1 wherein the glass forming the vase-shaped body is substantially translucent.

3. The lamp holder of claim 1 wherein the glass forming the vase-shaped body is substantially transparent.

* * * * *